US007144218B2

(12) United States Patent
Dube et al.

(10) Patent No.: US 7,144,218 B2
(45) Date of Patent: Dec. 5, 2006

(54) ANTI-ROTATION LOCK

(75) Inventors: David P. Dube, Saco, ME (US); Richard K. Hayford, Cape Neddick, ME (US)

(73) Assignee: United Technologies Corporation, Hartford, CT (US)

( * ) Notice: Subject to any disclaimer, the term of this patent is extended or adjusted under 35 U.S.C. 154(b) by 364 days.

(21) Appl. No.: 10/827,103

(22) Filed: Apr. 19, 2004

(65) Prior Publication Data

US 2006/0153683 A1 Jul. 13, 2006

(51) Int. Cl.
*F01D 25/24* (2006.01)

(52) U.S. Cl. ..... 415/189; 415/209.2; 415/209.3

(58) Field of Classification Search ..... 415/209.2, 415/209.3, 189, 191; 416/215
See application file for complete search history.

(56) References Cited

U.S. PATENT DOCUMENTS

| | | | | |
|---|---|---|---|---|
| 2,915,281 | A | | 12/1959 | Ridley et al. |
| 2,974,928 | A | | 3/1961 | Ridley |
| 3,104,091 | A | | 9/1963 | Vivian |
| 4,219,286 | A | | 8/1980 | Lindenthal |
| 4,632,634 | A | * | 12/1986 | Vinciguerra et al. ..... 415/189 |
| 5,846,050 | A | | 12/1998 | Schilling |
| 6,296,443 | B1 | | 10/2001 | Newman |
| 6,537,022 | B1 | | 3/2003 | Housley et al. |
| 6,585,479 | B1 | | 7/2003 | Torrance |
| 2003/0068225 | A1 | | 4/2003 | Housley et al. |
| 2003/0082051 | A1 | | 5/2003 | Bertrand et al. |

* cited by examiner

*Primary Examiner*—Richard A. Edgar
(74) *Attorney, Agent, or Firm*—Colin L. Cini

(57) ABSTRACT

An anti-rotation lock for preventing circumferential movement of a stator segment in relation to a split case to which it is mounted is disclosed. A racetrack shaped pocket, disposed within the case and proximate the stator segment, is suitably sized to receive a lug and a spring pin. The lug is received in the pocket and protrudes radially inward from the case and is engagable by the stator segment, thus preventing circumferential movement with respect to the case. The spring pin is received adjacent to the lug and compressively retains the lug in the pocket.

9 Claims, 4 Drawing Sheets

ANTI-ROTATION LOCK

STATEMENT REGARDING FEDERALLY SPONSORED RESEARCH OR DEVELOPMENT

This invention was made with Government support under N00019-02-C-3003 awarded by the United States Navy. The Government has certain rights in this invention.

BACKGROUND OF THE INVENTION (1) Field of the Invention

The invention relates to gas turbine engine components, and more particularly to an anti-rotation lock for preventing relative movement between two such components.

(2) Description of the Related Art

A gas turbine engine includes one or more forward compressor sections for increasing the pressure of an incoming air stream. Each compressor section includes alternating axial stages of rotating, rotor blades and stationary, stator vanes disposed within a casing structure. The stator vanes are supported by outer shrouds or by inner and outer shrouds. The outer shrouds include a pair of circumferentially extending rails for use in assembly with the casing structure. Multiple stator vanes may be manufactured as a single module, referred to as a stator segment. Stator segments are less expensive to manufacture and allow less air leakage than individual stator vanes.

To simplify assembly with the rotor blades, the casing structure is typically split axially into two or more arcuate sectors, referred to as a split case. Circumferential grooves, within the internal periphery of the split case, accept the circumferential rails of the stator segment. A thickened flange is located radially outward from the split case for joining the split case with fasteners during assembly. The thickened flanges are referred to as split flanges.

During assembly, each stator segment is inserted into the split case by engaging the stator segment rails with the corresponding circumferential grooves in the case. Each stator segment is guided into the grooves in turn, until all of the stator segments are loaded. The split case is next fit around a pre-assembled rotor and joined by fasteners at the split flanges.

During normal operation of the gas turbine engine, temperature variations between the split case and the stator segments necessitate a suitable cold-clearance gap between adjacent stator segments. Also, aerodynamic loading of each stator segment generates a tangential force approaching five hundred pounds. In order to uniformly distribute the cold-clearance gaps and prevent circumferential sliding of the stator segments in the split case grooves, anti-rotation locks must be utilized for each stator segment.

The requirement for an anti-rotation lock is particularly important at the locations adjacent to the split flanges. If the stator segments rotate circumferentially in the split case grooves and bridge the split flange after assembly, disassembly of the compressor may be difficult or even impossible. Because the split flanges are thicker than the remainder of the split case, contain a plurality of fasteners and are a source of air leakage, an unconventional anti-rotation lock is required at this location.

Anti-rotation locks of the type described in U.S. Pat. No. 6,537,022 to Housley, et al., are effective in areas of a split case where the locks do not interfere with any external casing features, such as fasteners. In the area of the split flange; however, the fasteners attaching the case sectors preclude their use. Anti-rotation locks as described in U.S. Pat. App. 2003/0082051 to Bertrand, et al., although effective, require precise machining of the split case grooves and stator segments and are susceptible to vibratory wear. Each of the above locks may contribute to increased engine weight and air leakage, which are important considerations as well.

What is needed is an anti-rotation lock for use at a split flange that does not interfere with external casing features, does not require extensive machining, is not susceptible to vibration and has minimal impact on engine weight and air leakage.

BRIEF SUMMARY OF THE INVENTION

Provided is an anti-rotation lock for preventing relative movement between a stator segment and a split case of a gas turbine engine to which it is mounted.

An anti-rotation lock contains a pocket in a split case for receiving a lug and a spring pin. The lug protrudes radially inward from the case for engaging a stator segment. The spring pin received in the pocket and adjacent to the lug provides compressive loading of the lug in the pocket.

Other features and advantages will be apparent from the following more detailed descriptions, taken in conjunction with the accompanying drawings, which illustrate, by way of example, an exemplary embodiment anti-rotation lock.

BRIEF DESCRIPTION OF THE SEVERAL VIEWS OF THE DRAWINGS

When referring to the drawings, it is understood that like reference numerals designate identical or corresponding parts throughout the several views.

DETAILED DESCRIPTION OF THE INVENTION

Figure 1:
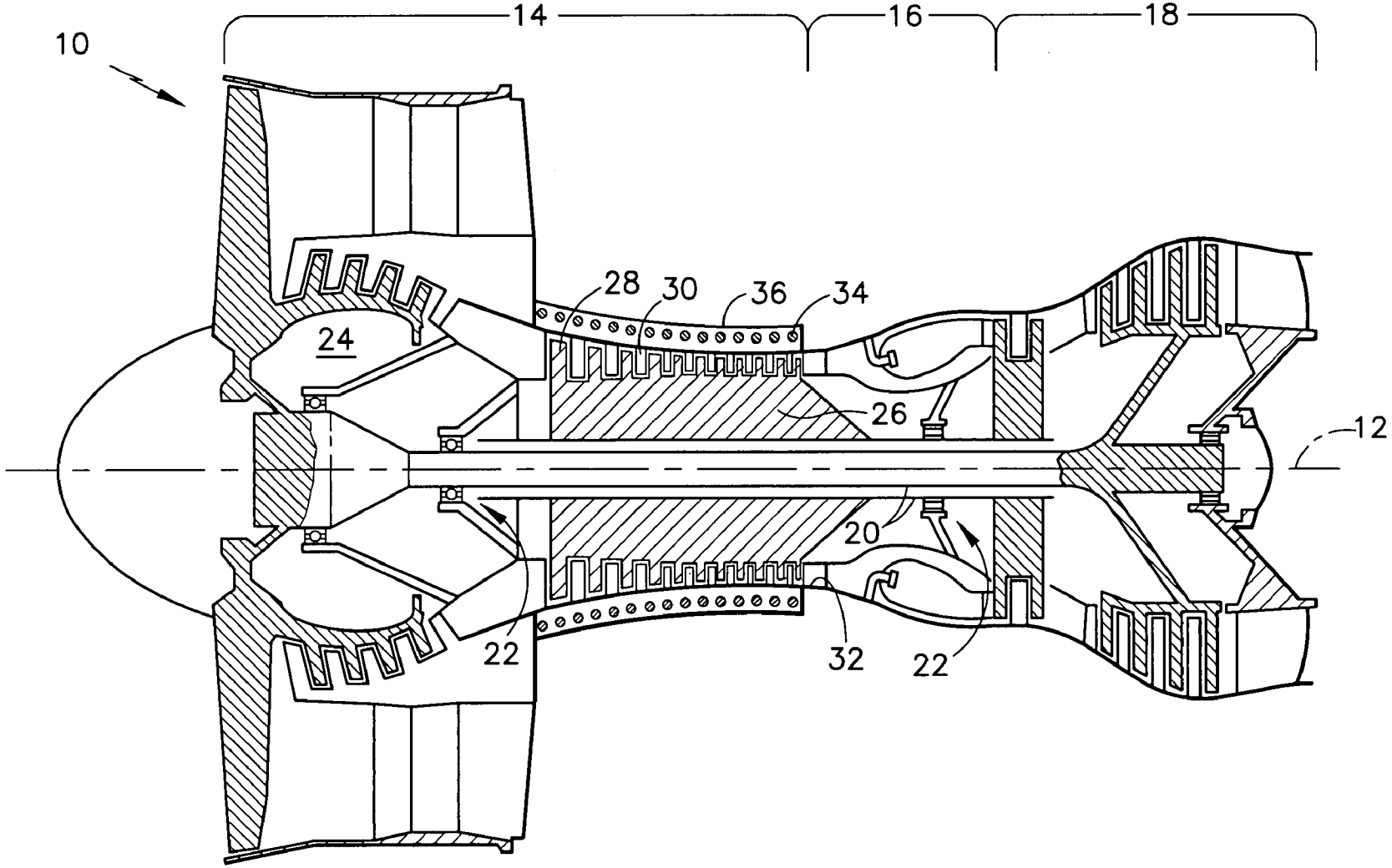
FIG. 1 is a simplified schematic sectional view of a gas turbine engine along a central, longitudinal axis.

Referring to FIG. 1, a gas turbine engine 10 with a central, longitudinal axis 12 contains one or more compressors 14, a combustor 16 and one or more turbines 18. Compressed air is directed axially rearward from the compressors 14, is mixed with fuel and ignited in the combustor 16 and is directed into the turbines 18 and is eventually discharged from the gas turbine engine 10 as a high velocity gas jet. The turbines 18 drive the compressors 14 through common shafts 20 supported by bearings 22. The gas turbine engine in this example contains two compressors, a low-pressure compressor 24 and a high-pressure compressor 26.

A typical gas turbine engine high-pressure compressor 26 includes alternating axial stages of rotating, rotor blades 28 and stationary, stator vanes 30 disposed within a casing structure 32 made of aluminum, titanium, steel or nickel alloy. The casing structure 32 is typically split axially into two or more arcuate segments, joined together by fasteners 34 at one or more split flanges 36. A casing structure of this type is hereinafter referred to as a split case.

Stator vanes 30 may be variable or fixed pitch. Variable pitch stator vanes pivot about a series of trunnions in the split case 32, while fixed pitch stator vanes maintain a constant angle. Fixed pitch stator vanes 30 are supported by an outer shroud 38 (shown in FIG. 2), and in some instances, an inner shroud 40. Typically, a number of fixed pitch stator vanes 30 may be manufactured together in a single module, called a stator segment. Stator segments are cantilevered radially inward from the split case 32 by the outer shrouds 38.

Figure 2:
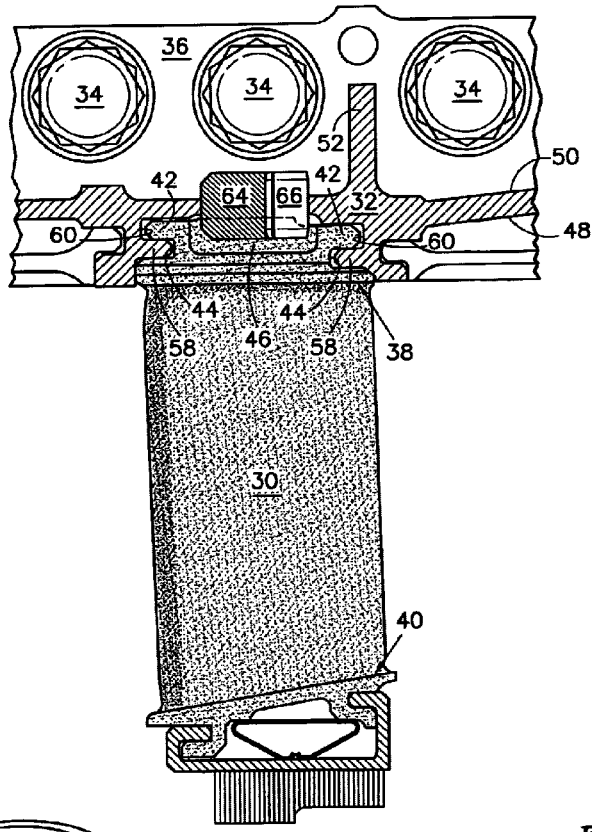
FIG. 2 is a partial sectional side view of a stator segment assembled in a split case.

A stator segment 30 is shown in FIG. 2 installed in a split case 32. The stator segment 30 includes a pair of 'L' section, segment rails 42 extending radially outward from, and circumferentially about, the outer shroud 38. The areas radially between the segment rails 42 and the outer shroud 38 form a pair of segment grooves 44. Except for a circumferentially localized stop 46, the material extending axially between the segment rails 42 is removed to reduce weight. Although the foregoing describes a stator segment, it is to be understood that non-segmented stator vanes comprise similar construction details.

The split case 32 of FIG. 2 comprises a radially inner surface 48 a radially outer surface 50 and one or more circumferential ribs 52 for reducing deflection when an internal pressure load is applied by the compressed air. A split flange 36 extends radially outward from the outer surface 50 and axially the length of the split case 32. A number of holes 54 (shown in FIGS. 3,4) penetrate the split flange 36 for use in joining the split case 32 with fasteners 34 during assembly. Extending radially inward from the inner surface 48 at the axial location of the stator segments 30, are pairs of 'L' section case rails 58. The areas radially between the case rails 58 and the inner surface 48, form circumferential case grooves 60. The case grooves 60 correspond to the segment rails 42, allowing a stator segment to be introduced into the inner case in a sliding arrangement during assembly.

Figure 3:
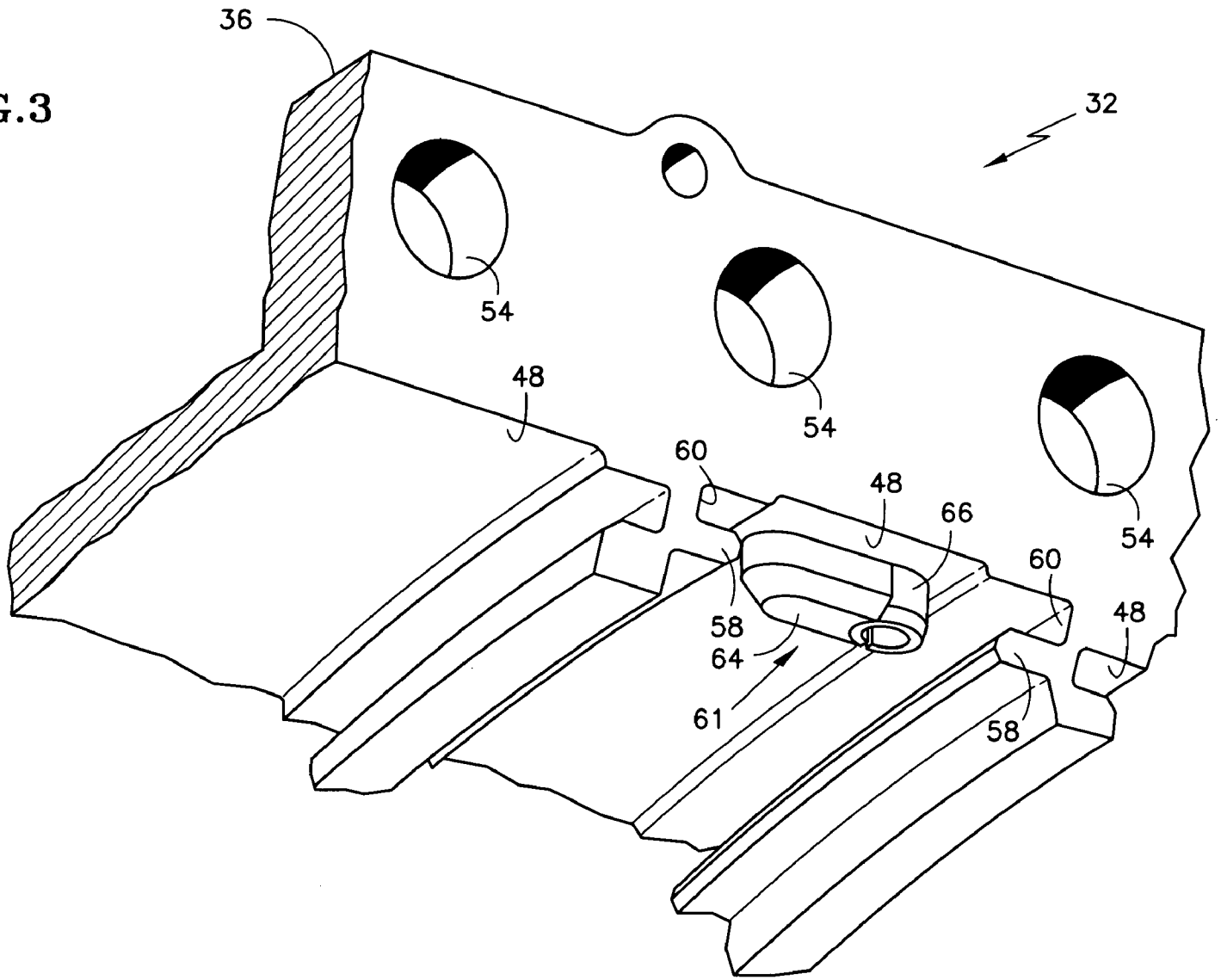
FIG. 3 is a partial perspective view of a split case and an anti-rotation lock installed adjacent to a split flange.
Figure 4:
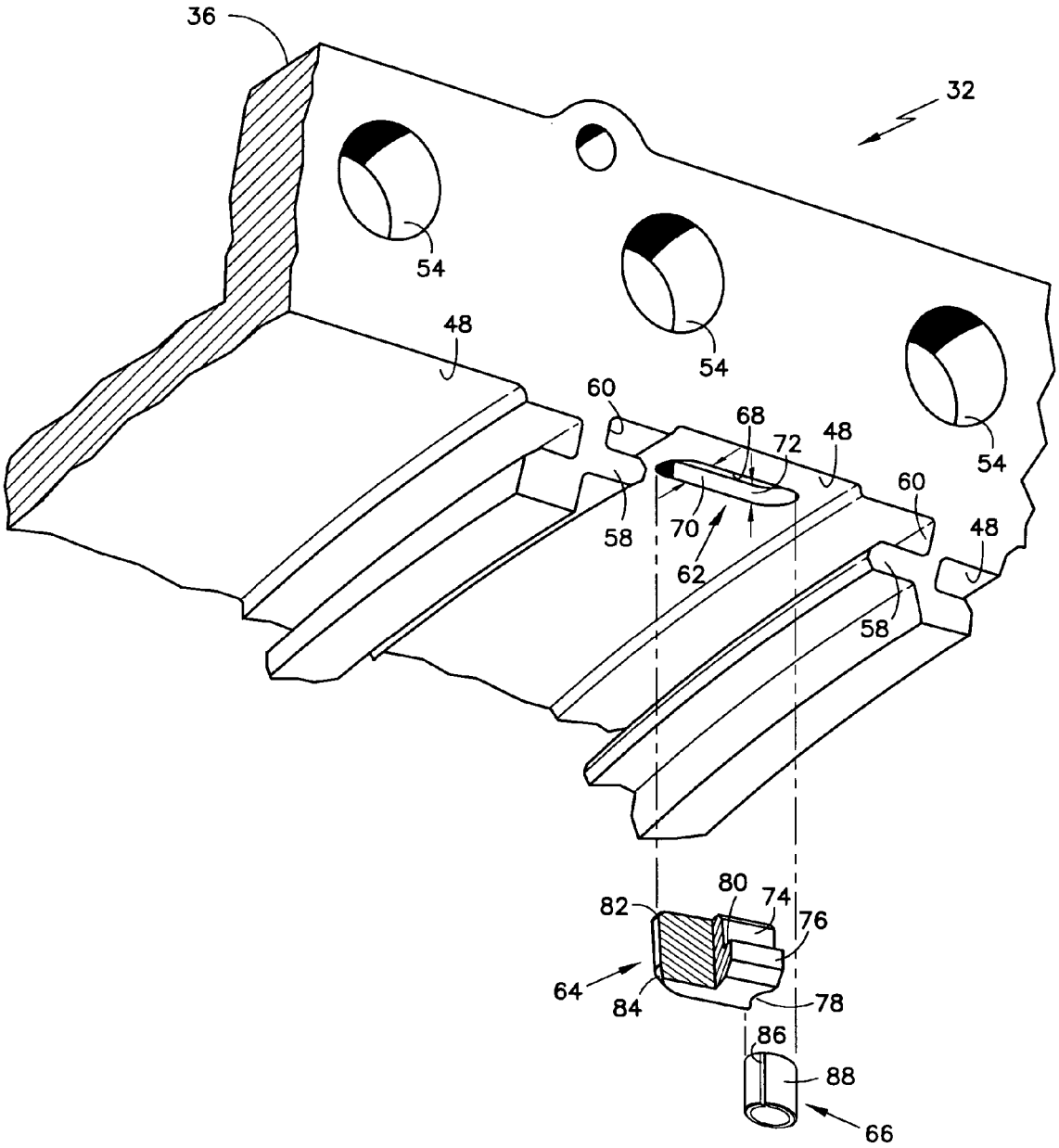
FIG. 4 is a partial perspective view of a split case with an anti-rotation lock of FIG. 3 in exploded view.

Referring now to FIGS. 3 and 4, an anti-rotation lock 61 is installed in a split case 32, between a pair of case rails 58 and adjacent to a split flange 36. The anti-rotation lock 61 comprises a pocket 62, a lug 64 and a spring pin 66. The lug 64 is received in the pocket 62, and protrudes radially inward from the inner surface 48 for engaging a stator segment 30. The spring pin 66 is compressed slightly while received in the pocket 62, adjacent to the lug 64. The compressive loading of the spring pin 62 prevents movement of the lug 64 within the pocket 62 due to vibration and cyclic loading during normal operation. A more detailed description of the various features of the anti-rotation lock 61 follows.

The pocket 62 as shown in FIG. 4 may be racetrack shaped with an axial length 68, circumferential width 70 and radial depth 72 sized to accept the lug 64 and the spring pin 66. The radial depth 72 does not intersect the holes 54 and does not contribute to any compressed air leakage. In one example, the pocket is machined using a conventional, 0.250 inch milling cutter; however, forging, electrodischarge machining (EDM) or any other suitable method may be used.

The lug 64 includes a base 74, a crown 76 and a recess 78, conforming to the shape of the engaged spring pin 66. The base 74 is received in the pocket 62 and the crown 76 protrudes radially inward from the inner surface 48 of the split case 32. The crown 76 extends beyond the circumferential width 70 of the pocket 62, forming an overhang 80. The overhang 80 ensures the stator segment 30 engages only the crown 76 of the lug 64 and not the spring pin 66. A base chamfer 82 ensures full radial engagement of the base 74 in the pocket 62, and a crown chamfer 84 prevents interference between the crown 76 and the stator rails 42. The recess 78 conforms to the curvature of the engaged spring pin 66 to ensure consistent contact and to prevent a loss of compressive loading. In one example, the lug 64 is made of nickel; however, stainless steel or any other suitable material may be used.

Figure 5:
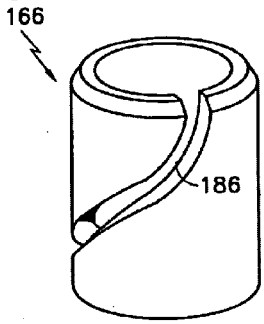
FIG. 5 is a perspective view of an alternate example of a spring pin.
Figure 6:
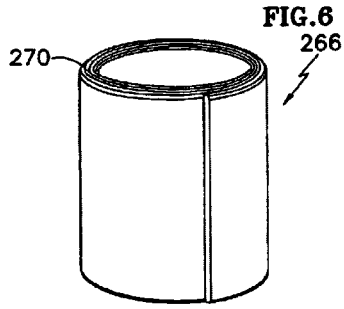
FIG. 6 is a perspective view of yet another alternate example of a spring pin.

A first example of a spring pin 66 is a hollow cylinder, split lengthwise by a single slot 86. Alternately, a spring pin 166 (shown in FIG. 5 may include a single helical slot 186 or a spring pin 266 (shown in FIG. 6 may contain a coil 270 instead of a slot. An outer diameter 88 of the spring pin 66 is slightly larger than the pocket width 70 prior to being received in the pocket 62. When the spring pin 66 is received in the pocket 62, the outer diameter 88 is compressed slightly to fit inside the pocket width 70. The received spring pin 66 exerts a compressive load that retains the lug 64 in the pocket 62, thus preventing excessive wear due to vibration and cyclic loading during operation.

The foregoing has described an anti-rotation lock for preventing circumferential movement between a stator segment and a split case to which it is mounted. It will be apparent to those skilled in the art that various modifications thereto can be made without departing from the spirit and scope of the appended claims.

What is claimed is:

1. An anti-rotation lock for preventing circumferential movement of a stator segment in relation to a gas turbine engine split case to which it is mounted, comprising:
- a split case;
- a pocket disposed within said case at a location thereon proximate to said vane segment;
- a lug, received within said pocket and protruding inwardly from an inner surface of said case and engagable by said vane segment to prevent circumferential movement thereof with respect to said case; and
- a spring pin received within said pocket and engaged with said lug to compressively retain said lug within said pocket.

2. The anti-rotation lock of claim 1, wherein:
- said lug overhangs said pocket, extending beyond said spring pin in the circumferential direction.

3. The anti-rotation lock of claim 2, wherein:
- said lug further comprises an innermost radial face and an outermost radial face; and
- each of said faces are chamfered about at least a portion of their periphery.

4. The anti-rotation lock of claim 3, wherein:
- said case further comprises at least one pair of circumferentially extending and axially spaced apart rails, protruding inward from the inner surface and forming a corresponding pair of grooves for accepting the stator segment in a sliding arrangement.

5. The anti-rotation lock of claim 4, wherein:
- said spring pin further comprises an outer diameter; and
- the outer diameter is larger than a circumferential width of said pocket prior to being received in said pocket.

6. The anti-rotation lock of claim 5, wherein:
- said spring pin further comprises a hollow cylinder, split lengthwise by a linear slot.

7. The anti-rotation lock of claim 5, wherein:
- said spring pin further comprises a hollow cylinder, split by a helical slot.

8. The anti-rotation lock of claim 6, wherein:

said lug further comprises a recess, positioned between the innermost and the outermost faces and adjacent to the received spring pin.

9. The anti-rotation lock of claim 8, wherein:

the recess is concave and corresponds to the outer diameter of said received spring pin.

* * * * *